United States Patent [19]

Hume

[11] Patent Number: 4,635,691

[45] Date of Patent: Jan. 13, 1987

[54] VOLUME RESPONSIVE LIQUID DISCHARGE NOZZLE

[75] Inventor: Ronald W. Hume, Clearwater, Fla.

[73] Assignee: Equip-Mark, Inc., Tierre Verde, Fla.

[21] Appl. No.: 754,981

[22] Filed: Jul. 15, 1985

[51] Int. Cl.[4] ..... B65B 3/04

[52] U.S. Cl. ..... 141/94; 141/198; 141/360; 328/5; 367/93

[58] Field of Search ..... 328/5; 367/93; 141/94, 141/95, 96, 198, 360, 361, 362, 1-12

[56] References Cited

U.S. PATENT DOCUMENTS

| | | | |
|---|---|---|---|
| 4,202,387 | 5/1980 | Upton | 141/94 |
| 4,236,553 | 12/1980 | Reichenberger | 141/198 |
| 4,437,497 | 3/1984 | Enander | 141/198 |
| 4,440,200 | 4/1984 | De Vale et al. | 141/95 |
| 4,458,735 | 7/1984 | Houman | 141/95 |

*Primary Examiner*—Houston S. Bell, Jr.

[57] ABSTRACT

A liquid discharge nozzle that dispenses liquid upon demand in a quantity that matches the volumetric capacity of the cup used to activate the nozzle. The nozzle has a first and second pair of diametrically opposed switch members that are disposed radially inwardly and outwardly, respectively, of an annular divider wall that depends to a bottom wall of the nozzle housing. The rim of a cup having a diameter less than the diameter of the divider wall engages the radially inwardly disposed switch members. The switch members, when so engaged or activated, make a call for service which results in the dispensing of the correct volume of liquid for that cup. The rim of a cup having a diameter greater than the diameter of the divider wall engages the radially outwardly positioned switch members which switch members when actuated cause liquid to be dispensed into the cup in the proper amount for that cup.

8 Claims, 3 Drawing Figures

VOLUME RESPONSIVE LIQUID DISCHARGE NOZZLE

BACKGROUND OF THE INVENTION

1. Field of the Invention

This invention relates to liquid discharge nozzles, and more specifically relates to a liquid discharge nozzle that dispenses different quantities of liquid in response to calls for service made by cups of differing sizes.

2. Description of the Prior Art

Liquid discharge nozzles are in widespread use throughout the world. Typically, they are used in establishments that sell soft drinks, juices and the like for consumption on or off the premises. These establishments typically provide the drinks in small, medium or large sizes so that the consumer may purchase a drink in accordance with his or her degree of thirst.

Many establishments today are using two (2) sizes of drinks, said sizes being the six ounce (6 oz.) and the ten ounce (10 oz.) sizes. Regardless of the number of differing sizes of drinks available, however, the operators of the dispensing machines commonly fail to match the volumetric capacity of the cup selected with the amount of liquid actually dispensed by the machine. Thus, a ten ounce cup may be used when filling an order for a six ounce drink. This makes the customer feel cheated when the apparent emptiness of the cup is observed. Worse still, when a six ounce cup is selected to receive a ten ounce drink, at least four ounces (4 oz.) of liquid are wasted when the cup overflows.

Many establishments have liquid discharging machines that cannot dispense measured amounts, such as six or ten ounces, but must be operated by the personnel of the establishment to ensure that the order for a drink of a certain size is complied with. The operation typically involves the pressing of a cup against a biased switch means, which operation requires the presence of the cup-filler during the cup filling process.

There is a need for a discharge nozzle that need only be activated by the operator of the drink-dispensing machine with which it as associated so that the operator need not attend the machine during the cup-filling process.

Moreover, there is a need for a liquid discharge nozzle that senses the volumetric capacity of the cup presented to it so that the proper amount of liquid will be discharged thereinto.

Pending U.S. patent application bearing Ser. No. 06/709,098, filed 03/07/85 by the present inventor and entitled "Apparatus for Reconstituting a Concentrate" discloses a nozzle member in FIG. 6 that dispenses liquids of all types, including liquids of the type having pulp, such as orange juice. The nozzle includes an upstanding open-ended tubular member positioned in a bore formed in a nozzle housing. Juice and pulp are discharged by the nozzle only after overflowing the bore, the upper open end of the tubular member acting as a weir so that pulp may overflow the same and enter into the cup positioned below the open-ended tubular member which serves as the nozzle.

The machine shown in such application is capable of dispensing six and ten ounce amounts of juice upon demand, and thus fulfills the need for a machine that does not require operator attendance during the cup-filling process. However, its sole drawback is that a careless operator can place a six ounce cup in position under the nozzle, and then press the ten ounce call for service switch, or vice versa.

There is a clear need for a machine that can only dispense amounts of liquids substantially equal to the volumetric capacity of the cup presented to the machine for filling, but the prior art contains no teachings or suggestions on how such a desireable machine could be provided.

SUMMARY OF THE INVENTION

The subject invention incorporates the nozzle of the above-mentioned U.S. patent application, and adds a number of features thereto that enable it to dispense liquids independent of the six and ten ounce call for service buttons provided as a part of the earlier invention.

Accordingly, a machine built in accordance with the teachings and suggestions of the aforesaid U.S. patent application and in accordance with the teachings and suggestions of the present disclosure would not include the six and ten ounce call for service buttons of the earlier invention, and in lieu thereof would include the means to be summarized herein and described in detail hereinafter.

The nozzle housing of the present invention includes a bottom wall to which depends an annular divider wall having a predetermined diameter. Specifically, the diameter of the divider wall is greater than the diameter of a cup rim of a six ounce cup and less than the diameter of a cup rim of a ten ounce cup.

A first pair of diametrically opposed spring-loaded switch members are positioned in the nozzle housing bottom wall so as to extend therefrom a small amount, radially inwardly of the divider wall member, and a second pair of diametrically opposed switch members are positioned radially outwardly of the divider wall.

The concept that underlies the present invention is the observation that the rims of six ounce cups are smaller in diameter than the rims of ten ounce cups. Accordingly, the first pair of switches are spaced apart by an amount substantially equal to the diameter of the rim of a six ounce cup. Similarly, the second pair of switches are spaced apart by an amount substantially equal to the diameter of the rim of a ten ounce cup.

With the switches so disposed on opposite sides of the divider wall, it is not possible for a machine operator to activate the six ounce call for service switches with a ten ounce cup, and vice versa. Both switches in a pair of diametrically opposed switches must be activated simultaneously, and the presence of the divider wall prevents both intentional and unintentional attempts to activate the wrong set of switches with a given cup.

It is therefore clear that the primary object of this invention is to provide a fool-proof liquid disharge nozzle mechanism that discharges six ounce quantities of liquid into six ounce cups and ten ounce quantities of liquid into ten ounce cups.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
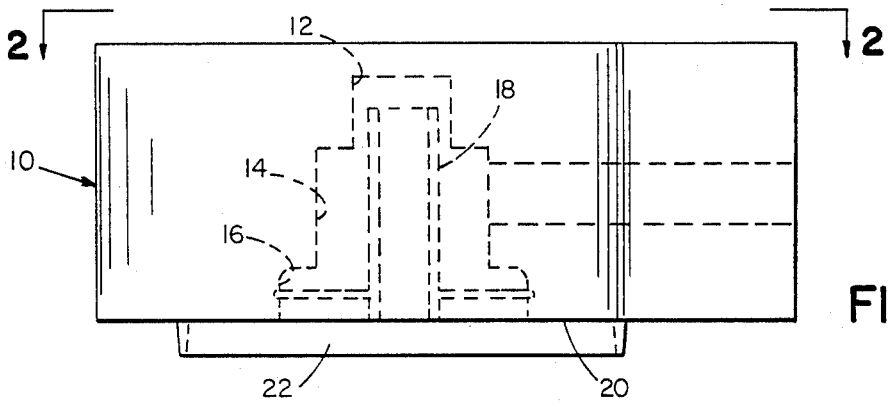
FIG. 1 is a side elevational view showing the housing of the novel nozzle.

Referring now to FIG. 1, it will there be seen that the nozzle housing of the present invention is designated by the reference numeral 10 as a whole.

A bore having three different diameters is formed in housing 10 as shown. The upper portion of the bore is designated 12, the middle portion, which is of greater diameter than upper portion 12, is designated 14, and the lower portion, of still greater diameter, is designated 16.

A nozzle member in the form of an open-ended, upstanding tubular member 18 is positioned substantially centrally of the bore, and includes an upper portion which extends into upper bore 12 as shown. Its lower portion lies flush with bottom wall 20 of housing 10.

An annular divider wall 22 having a diameter greater than the diameter of lower bore portion 16 depends to nozzle housing bottom wall 20 and is concentric with the bore as shown. The diameter of divider wall 22 is such that the rim of a six ounce cup will be disposed radially inwardly thereof when aligned concentrically therewith and the rim of a ten ounce cup when aligned concentrically therewith will be disposed radially outwardly thereof.

Figure 2:
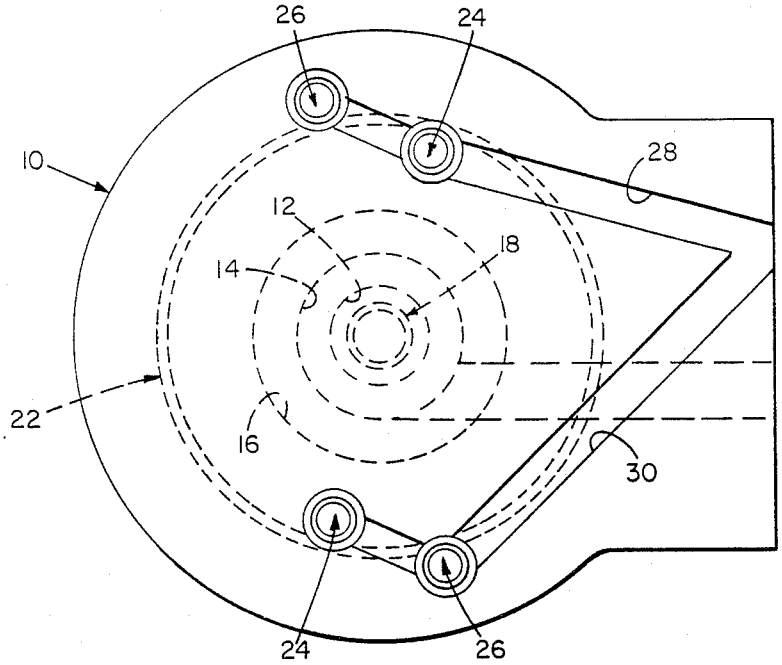
FIG. 2 is a plan view taken along line 2—2 of FIG. 1.

Referring now to FIG. 2, it will there be seen that a first pair of switches is indicated by the reference numerals 24, that the switches 24 are diametrically opposed to one another, and that they are positioned radially inwardly of divider wall 22. Similarly, it will be observed that a second pair of diametrically opposed switches are designated 26 and that switches 26 are positioned radially outwardly of divider wall 22.

Linear passageways 28 and 30 are conduit means that receive electrical wires that lead to the switches 24, 26 so that when paired switches are simultaneously activated, an electrical signal is carried by the wires in the passageways to controls shown in the above-mentioned U.S. patent application of the present inventor.

Figure 3:
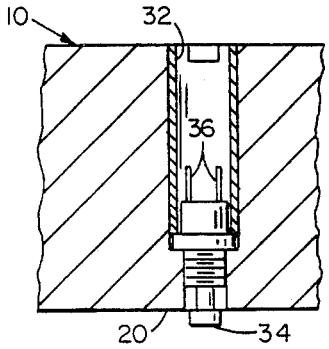
FIG. 3 is a detailed side elevational view of one of the button members or switches of the type used in the present invention.

FIG. 3 depicts one of the switches 24, 26 in greater detail. Each switch is positioned within a sleeve member 32 that abuts a shoulder portion of the switch as shown to prevent its retraction from the housing 10 when activated. The switch includes a depressable button 34 that extends downwardly from the bottom wall 20 of the nozzle housing 10 so that it can be depressed by the rim of a cup. Prongs 36 are connected to wires which carry a signal current as aforesaid when the button 34 is depressed. The switch may be of the spring-loaded type, or of any other type that returns to its equilibrium position when not engaged.

The operation of the inventive nozzle should now be apparent. When an operator selects a six ounce cup and delivers it to the nozzle station, the divider wall 22 will guide the cup into concentric alignment with it, radially inwardly thereof. The operator lifts the cup up a short distance so that its rim engages and depresses switches 24, and the liquid discharge will begin. For reasons explained in the co-pending, aforementioned patent application, the operator may now place the cup on a support surface beneath the discharge nozzle, and leave the area to do other work as the nozzle will shut itself off when six ounces of liquid have been dispensed.

Similarly, when the operator of the machine selects a ten ounce cup, the divider wall 22 will guide its rim to a concentric position therewith, radially outwardly thereof. Again, a lifting of the cup will cause its rim to depress and thereby activate switches 26, which activation results in a ten ounce call for service. The operator may rest the cup on the support surface provided for such purpose and leave the area without observing or otherwise supervising the operaton of the machine.

It should be apparent that the rim of a six ounce cup cannot simultaneously come into contact with both switches 26, nor can the rim of a ten ounce cup engage switches 24 simultaneously.

Accordingly, a fool-proof mechanism is provided and the limitations of the prior art are overcome.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, that which is claimed is:

1. A beverage dispenser for dispensing beverage into empty cups of different sizes, said different sized cups having different rim diameters, said dispenser comprising dispensing means for dispensing beverage in first and second volumes corresponding to first and second cup sizes, receiving means for receiving said cups of different sizes in position for filling said cups with respective volumes of beverage from said dispensing means, said receiving means including a generally horizontal bottom wall with an exposed downwardly directed surface, said dispensing means including a nozzle for directing said beverage to said cups in filling position under said horizontal bottom wall, said dispensing means including a source of beverage connected to said nozzle and an on/off beverage flow control mechanism, a first sensor carried by said bottom wall in position to sense a rim portion of a cup of a first cup size brought into proximity to said first sensor and to activate said dispensing means to dispense said first volume, a second sensor carried by said bottom wall and spaced from said first sensor in position to sense a rim portion of a cup of a second cup size brought into proximity to said second sensor and to activate said dispensing means to dispense said second volume, and a guard carried by said bottom wall preventing a rim portion of a cup of said first size from being sensed by said second sensor and a rim portion of a cup of said second cup size from being sensed by said first sensor.

2. The dispenser of claim 1 wherein said guard is located on the locus of points at horizontal distances from a vertical axis passing through said bottom wall, said horizontal distances being between the inner radius of the rim of a first cup size and the outer radius of a second smaller cup size, whereby the rim of a cup of said first size is directed outward of said guard, and the rim of a cup of said second cup size is directed inward of said guard, and wherein said second sensor is located at a radial position inward of said guard and said first sensor is located at a radial position outward of said guard.

3. The dispenser of claim 2 wherein there are two sensors for each cup size, said two sensors being spaced from each other, and wherein said dispensing means includes means for causing dispensing only after both sensors for a given cup size have been activated.

4. The dispenser of claim 3 wherein said two sensors for each cup size are on opposite sides of said vertical axis.

5. The dispenser of claim 3 wherein said sensors are downwardly directed depressable contact switches that are activatable by a cup rim pushed upwardly against them.

6. The dispenser of claim 2 wherein said dispensing means comprises a discharge tube carried by said bottom wall inside of said guard.

7. The dispenser of claim 2 wherein said guard comprises a continuous annular divider wall extending downward from said bottom wall.

8. The dispenser of claim 1 wherein said dispensing means comprises means for defining a chamber extending upward from said bottom wall and a vertically positioned discharge tube having a lower end substantially coplanar with said bottom wall and an upper end within said chamber, and means for providing beverage to said chamber, whereby said beverage is dispensed by entering said chamber and overflowing into said tubular member.

* * * * *